US006575079B2

(12) United States Patent
Lim et al.

(10) Patent No.: US 6,575,079 B2
(45) Date of Patent: Jun. 10, 2003

(54) SWASH PLATE COMPRESSOR

(75) Inventors: Kweon-soo Lim, Daejeon (KR); Hwan-kyun Park, Daejeon (KR)

(73) Assignee: Halla Climate Control Corporation, Daejeon (KR)

( * ) Notice: Subject to any disclaimer, the term of this patent is extended or adjusted under 35 U.S.C. 154(b) by 0 days.

(21) Appl. No.: 09/955,047

(22) Filed: Sep. 19, 2001

(65) Prior Publication Data

US 2002/0117050 A1 Aug. 29, 2002

(30) Foreign Application Priority Data

Feb. 23, 2001 (KR) ..... 2001-0009263

(51) Int. Cl.[7] ..... F01B 3/00
(52) U.S. Cl. ..... 92/12.2; 92/71
(58) Field of Search ..... 92/12.2, 71; 91/499; 74/60; 417/269

(56) References Cited

U.S. PATENT DOCUMENTS 5,937,735 A * 8/1999 Shimizu et al. ..... 92/12.2

FOREIGN PATENT DOCUMENTS

JP 57134370 U1 * 8/1982

* cited by examiner

*Primary Examiner*—Edward K. Look
*Assistant Examiner*—Thomas E. Lazo
(74) *Attorney, Agent, or Firm*—Leydig, Voit & Mayer, Ltd.

(57) ABSTRACT

A swash plate compressor includes a drive shaft rotated by a driving source, a swash plate fixedly installed at the drive shaft, a piston reciprocated by the swash plate, a cylinder bore in which the piston is slidingly installed for guiding reciprocation of the piston, a thrust bearing supporting a thrust force generated by the swash plate and the drive shaft, a race having a radial protrusion for preventing rotation at an outer circumference, and a cylinder block having a protrusion fixing element for preventing rotation of the race by fixing the protrusion of the race. Thus, abrasion due to rotational friction between the flat surface of the race and the thrust surface of the cylinder block can be prevented. Also, since generation of a gap between the cylinder block and the swash plate because of the abrasion of the flat surface of the race and the thrust surface of the cylinder block is prevented, noise in the compressor, damage to the thrust bearing, and damage to the neighboring member is prevented. Further, when incorrect assembly is performed, the protrusions interfere with the piston so that incorrect assembly can be easily detected and correct assembly can be easily performed.

7 Claims, 4 Drawing Sheets

SWASH PLATE COMPRESSOR

BACKGROUND OF THE INVENTION

1. Field of the Invention

The present invention relates to a swash plate compressor, and more particularly, to a swash plate compressor having an improved structure for preventing rotation of a race in the compressor.

2. Description of the Related Art

In an air conditioning apparatus for an automobile, a typical compressor enables refrigerant to continuously circulate by sucking heat exchange medium vaporized in an evaporator, compressing the sucked heat exchange medium, and pumping the compressed heat exchange medium. The compressor is classified into various types such as a swash plate type, a scroll type, a rotary type, and a wobble plate type based on a driving method.

FIG. 1 shows an example of a swash plate type compressor 100. Referring to the drawing, the swash plate type compressor 100 includes a plurality of pistons 112 installed in a cylinder block 111 to be inserted therein and a drive shaft 113 is installed at the central portion of the cylinder block 111. A boss 112*a* having a shoe pocket (not shown) for accommodating a shoe (not shown) to facilitate smooth sliding of the pistons 112 with respect to a swash plate 114 is formed in the middle portion of each of the pistons 112. Since the swash plate 114 coupled to the drive shaft 113 is inserted in the boss 112*a*, when the swash plate 114 rotates, the pistons 112 can sequentially reciprocate in the lengthwise direction of the cylinder block 111.

A thrust bearing 120 is installed so that rotational movements of the swash plate 114 is converted to reciprocating movements of the pistons 112 at both sides of the swash plate 12.

Races 121*a* and 121*b* are interposed between the swash plate 114 and the thrust bearing 120, and a thrust surface 111*c* (see FIG. 2A) and the thrust bearing 120, respectively, at both sides of the thrust bearing 120. The races 121*a* and 121*b* guide needle type rollers 120*a* in the thrust bearing 120.

A valve plate 115 where suction holes 115*a* and discharge holes 115*b* are formed is installed at both sides of the cylinder block 111. A thin plate type suction reed 116 for opening and shutting the suction holes 115*a* and an discharge reed 117 for opening and shutting the discharge holes 115*b* are installed at both sides of the valve plate 115. A front head 118 and a rear head 119 are installed at both sides of the cylinder block 111 where the suction reed 116 and the discharge reed 117 are installed.

In the typical swash plate type compressor having the above structure, when the drive shaft 113 is rotated by a predetermined driving means (not shown), the swash plate 114 installed at the drive shaft 113 rotates so that the pistons 112 radially arranged at the cylinder block 111 are reciprocated. As the pistons 112 reciprocate, heat exchange medium is sucked and discharged while being compressed. Here, the suction reed 116 and the discharge reed 117 open and shut the suction holes 115*a* and the discharge holes 115*b*, respectively, by the pressure of the sucked or compressed heat exchange medium.

However, during the operation of the above swash plate type compressor 100, when an impact is generated by an instantaneous thrusting force, the races 121*a* and 121*b* are elastically deformed and absorb the impact. Here, by the instantaneous elastic deformation by the impact, an insertion phenomenon that the thrust bearing 120 is instantaneously inserted between the races 121*a* and 121*b* and the cylinder block 11 occurs. Then, the roller 120*a* in the thrust bearing 120 does not rotate due to the insertion phenomenon and the race 121*b* rotates together with the thrust surface 111*c* of the cylinder block 111 while making friction therebetween.

Meanwhile, the race 121*a* at the right contacting a thrust surface of the swash plate 114 hardly generates rotation and abrasion due to the rotation. This is because the right race 121*a* contacts the thrust surface of the swash plate 114 in a large area while the left race 121*b* contact the thrust surface 111*c* of the cylinder block 111 in a small area.

Due to the above phenomenon, the thrust surface 111*c* of the cylinder block formed of a relatively softer material is excessively abraded so that the gap between the swash plate 114 and the cylinder block 111 is generated and parts subordinately affected generate noise inside the compressor. Also, since the performance of the races 121*a* and 121*b* guiding the roller 120*a* of the thrust bearing 120 deteriorates, the thrust bearing 120 cannot properly absorb an impact and generates noise and further the thrust bearing 120 itself is damaged. Furthermore, as the swash plate 114 freely moves, the suction reed 116 is damaged as the pistons 112 apply impacts to the suction reed 116.

To solve the above problem, an swash plate type compressor is disclosed in Japanese Utility Model Publication No. 57-134370 (published on Aug. 21, 1982). In this swash plate type compressor, a protrusion for preventing rotation which is bent toward a cylinder block is installed at the outer circumferential surface of a race. The rotation preventing protrusion is inserted in a bore formed in the cylinder block to prevent the rotation of the race.

However, in the above swash plate compressor, since only one rotation prevention protrusion is provided, directivity is produced when the cylinder block and the race are coupled together and assembly thereof becomes difficult. Thus, when misassembly occurs, the piston may be damaged. Also, since there is an accommodating structure in which the protrusion of the race is inserted into the bore, excessive movements of the race may generate noise and as the inner surface of the bore and the protrusion may collide, foreign materials may be generated.

SUMMARY OF THE INVENTION

To solve the above-described problems, it is an object of the present invention to provide a swash plate type compressor having a race on the outer circumference surface of which at least two protrusions for preventing rotation are formed, so that, when the race is coupled to the cylinder block, the accommodating structure for preventing rotation by distributing a rotational force of the race and assembly thereof is improved.

To achieve the above object, there is provided a swash plate type compressor comprising a drive shaft rotated by a driving source, a swash plate fixedly installed at the drive shaft, a piston reciprocated by the swash plate, a cylinder bore, where the piston is installed to be capable of sliding, for guiding reciprocation of the piston, a thrust bearing supporting a thrust force generated the swash plate and the drive shaft, a race having a protrusion for preventing rotation radially formed at an outer circumference thereof, and a cylinder block having a protrusion fixing means for preventing rotation of the race by fixing the protrusion of the race. Thus, abrasion due to rotational friction between the flat surface of the race and the thrust surface of the cylinder block can be prevented.

It is preferred in the present invention that the protrusion fixing means is at least one pair of protrusion stoppers formed to face each other around a drive shaft insertion hole of the cylinder block.

It is preferred in the present invention that the protrusion fixing means is at least a protrusion insertion hole formed around the drive shaft insertion hole of the cylinder block.

It is preferred in the present invention that at least two protrusions for preventing rotation are fixedly supported at the protrusion fixing means of the cylinder block.

It is preferred in the present invention that the protrusion for preventing rotation is formed at an identical interval.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Figure 1:
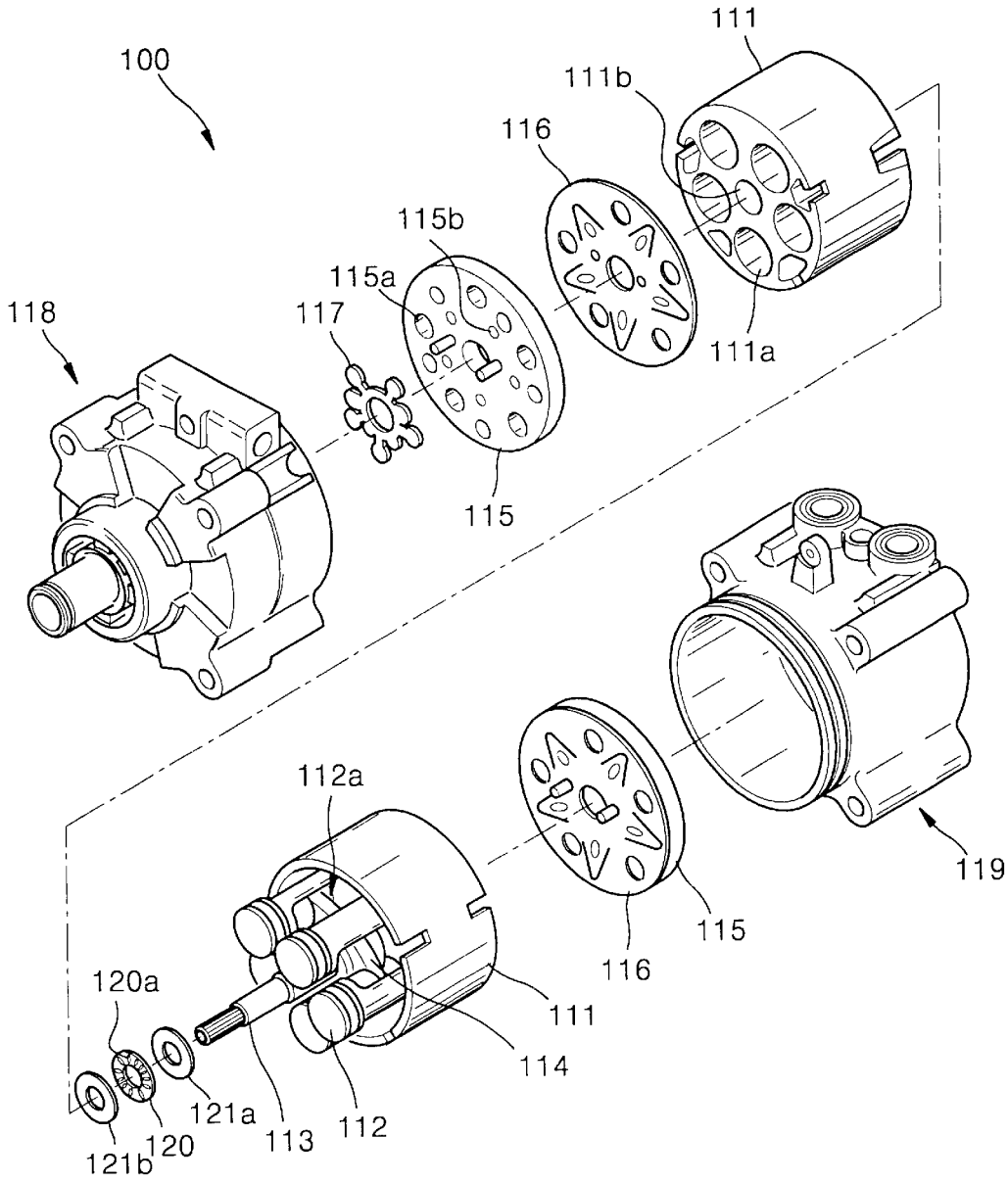
FIG. 1 (PRIOR ART)
FIG. 1 is an exploded perspective view showing an example of the conventional swash plate type compressor.

In a swash plate type compressor according to a preferred embodiment of the present invention, as shown in FIG. 1, a plurality of pistons 112 installed in a cylinder block 111 to be inserted therein and a drive shaft 113 rotated by a driving source (not shown) is installed at the central portion of the cylinder block 111. A bore 111*a* for limiting reciprocation of the pistons 112 inserted therein is formed in the cylinder block 111.

A valve plate 115 where suction holes 115*a* and discharge holes 115*b* are formed is installed at both sides of the cylinder block 111. A thin plate type suction reed 116 for opening and shutting the suction holes 115*a* and an discharge reed 117 for opening and shutting the discharge holes 115*b* are installed at both sides of the valve plate 115. A front head 118 and a rear head 119 are installed at both sides of the cylinder block 111 where the suction reed 116 and the discharge reed 117 are installed.

A boss 112*a* is formed in the middle portion of each of the piston 112, in which the swash plate 114 coupled to the drive shaft 113 is inserted. When the swash plate 114 rotates, pistons 112 sequentially reciprocate in the lengthwise direction of the cylinder block 111, so that sucking/compressing strokes are continuously performed at a particular phase difference.

A thrust bearing 120 is installed at both sides of the swash plate 114 to prevent the swash plate 114 and the drive shaft 113 from freely moving in the lengthwise direction and support a thrust force.

Races 121*a* and 121*b* are interposed between the swash plate 114 and the thrust bearing 120, and a thrust surface 111*c* (see FIG. 2A) and the thrust bearing 120, respectively, at both sides of the thrust bearing 120. The races 121*a* and 121*b* guide needle type rollers 120*a* in the thrust bearing 120.

Rotation preventing means 20, 30 and 40 for preventing rotation of the races 121*b* is provided at the races 121*b* and the cylinder block 111. The rotation preventing means 20, 30, and 40 will be described in detail with reference to FIGS. 2A through 4.

Figure 2A:
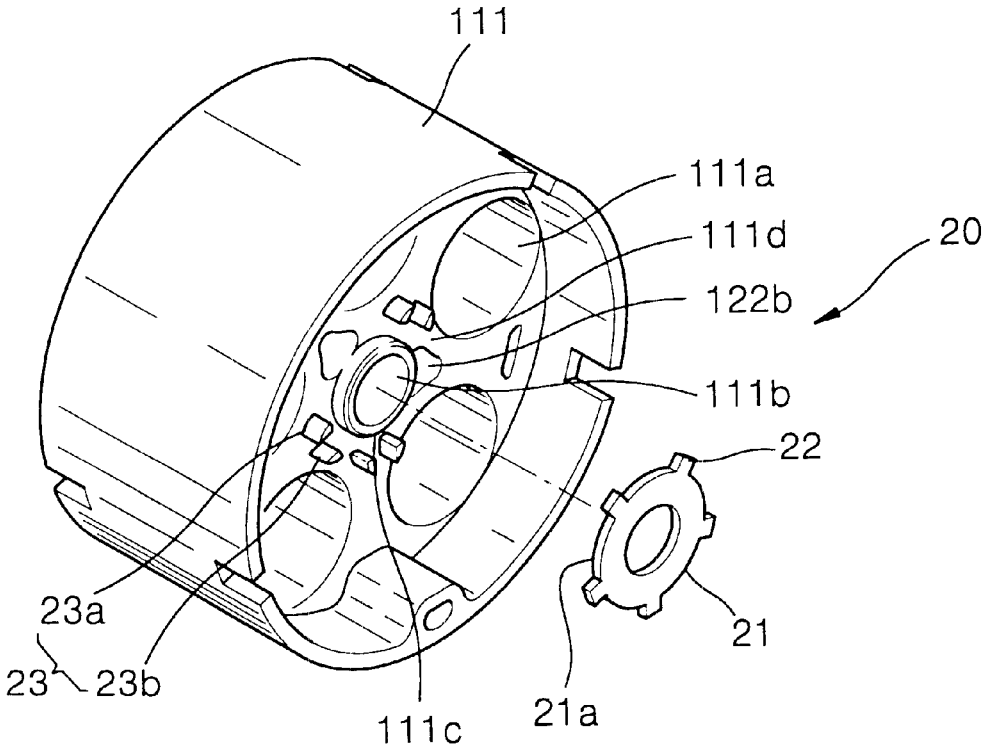
FIG. 2A is a perspective view showing a rotation preventing means according to a preferred embodiment of the present invention.

FIG. 2A shows a rotation preventing means 20 according to a preferred embodiment of the present invention. Referring to the drawing, the rotation preventing means 20 includes a protrusion 22 formed on the outer circumferential surface 21*a* of the race 21, and a stopper 23 formed on a surface 111*d* of the cylinder block 111. Five protrusions 22 are formed on the outer circumferential surface 21*a* of the race 21 on the same plane as the surface of the race 21 at a predetermined distance. The number of the protrusions 22 is not limited to the number shown in above preferred embodiment and at least one protrusion will suffice. The protrusion 22 may be attached to the race 21 but preferably formed to be integral with the race 21. The shape of the protrusion 22 is not limited to this preferred embodiment, but various shapes are available.

Also, the distance between a pair of stoppers 23*a* and 23*b* is preferably formed such that the protrusion 22 can be sufficiently inserted therebetween regardless of the shape of the protrusion 22. Since the distance between the protrusion 22 and stoppers 23*a* and 23*b* after insertion is too large, it may work as a noise source during the operation of the compressor. Thus, an appropriate distance is preferably maintained. At least the stopper 23 in a pair is formed on the surface 111*d* between the bores 111*a* of the cylinder block 111 adjacent to each other. The shape of the stopper 23 may be varied unless it is limited by other adjacent assembled parts. Although the stopper 23 may be attached to the cylinder block 111, it can be integrally formed with the cylinder block 111.

Figure 2B:
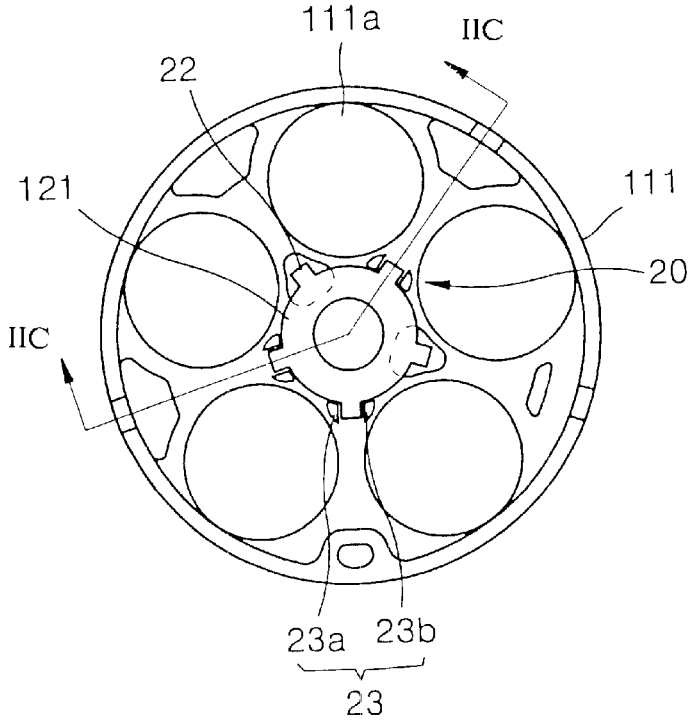
FIG. 2B is a plan view showing a state in which the cylinder block and the race of FIG. 2A is assembled.
Figure 2C:
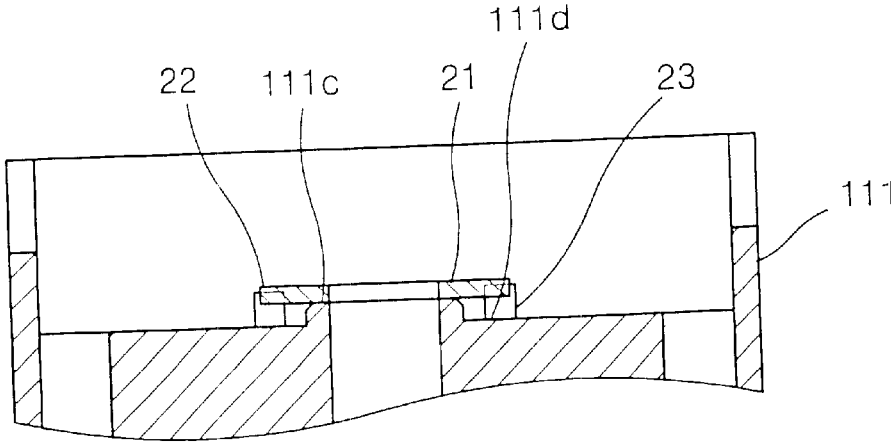
FIG. 2C is a sectional view taken along line of IIC—IIC in FIG. 2B.

Referring to FIGS. 2B and 2C, the protrusion 22 formed on the outer circumferential surface 21*a* of the race 21 is inserted between a pair of the stoppers 23*a* and 23*b* formed on the surface 111*d* of the cylinder block 111. Thus, as the protrusion 22 is inserted between the stoppers 23*a* and 23*b*, the race 21 is held in place.

During the assembly of the compressor, when the race 21 is not installed correctly, the protrusion 22 is disposed toward the bore 111*a* in the cylinder block 111, interfering with the pistons 112. Thus, during an assembly process, whether assembly is correctly performed can be checked so that incorrect assembly can be prevented. When the protrusion 22 is arranged at identical intervals, assembly can be easily performed.

Figure 3:
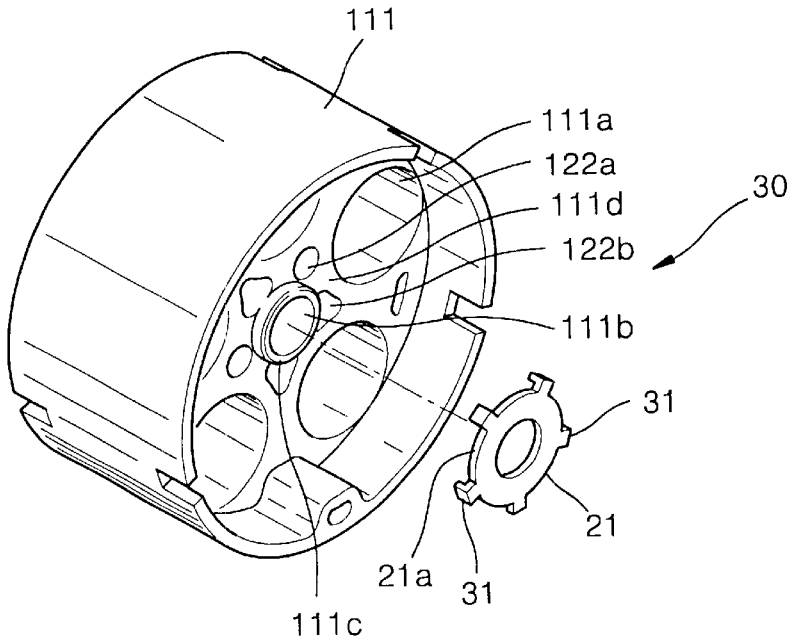
FIG. 3 is a perspective view showing a rotation preventing means according to another preferred embodiment of the present invention.

FIG. 3 shows the rotation preventing means 30 according to another preferred embodiment of the present invention. Referring to the drawing, five protrusions 31 are formed on the outer circumferential surface 21*a* of the race 21. The protrusions 31 are bent from the outer circumferential surface 21*a* of the race 21. The protrusions are inserted in circular coupling holes 122*a* formed in the surface 111*d* of the cylinder block 111 or non-circular coupling holes 122*b*. The protrusions 31 may be attached to the race 21 or integrally formed. The number of protrusions 31 is not limited to the above preferred embodiment and at lest two protrusions will suffice. Also, the protrusions 31 may be arranged in various ways.

Figure 4:
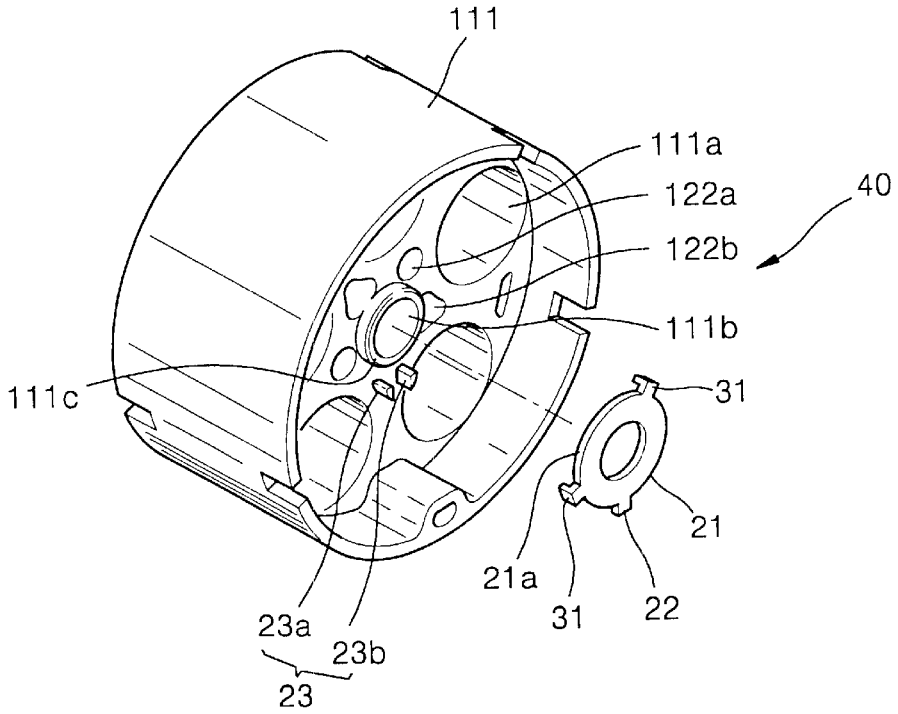
FIG. 4 is a perspective view showing a rotation preventing means according to yet another preferred embodiment of the present invention.

FIG. 4 shows the rotation preventing means 40 according to another preferred embodiment of the present invention. Referring to the drawing, two types of the protrusions 22 and 31 are formed on the outer circumferential surface 21*a* of the race 21. One type of the protrusion 31 is bent from the outer circumferential surface 21*a* of the race 21 while the other type of the protrusion 22 is not bent from the outer circumferential surface 21*a* of the race 21, but formed on the same plane of the race 21.

The bent protrusion 31 is inserted in a coupling hole 122*a* formed on the surface 111*d* of the cylinder block 111. The unbent protrusion 22 is inserted between a pair of stoppers 23*a* and 23*b* formed on the surface 111*d* of the cylinder block 111.

The number of protrusions 22 and 31 are not limited to the above preferred embodiment and at lest one bent protrusion and at least one unbent protrusion will suffice. Also, the protrusions 22 and 31 may be arranged in various ways. As the protrusions 22 and 31 are formed on the outer circumferential surface 21*a* of the race 21, the race 21 does not rotates while the thrust bearing 120 rotates.

While this invention has been particularly shown and described with reference to preferred embodiments thereof, it will be understood by those skilled in the art that various changes in form and details may be made therein without departing from the spirit and scope of the invention as defined by the appended claims.

As described above, the swash plate type compressor according to the present invention has the following advantages.

First, abrasion due to rotational friction between the flat surface of the race and the thrust surface of the cylinder block can be prevented.

Second, generation of a gap between the cylinder block and the swash plate because of the abrasion of the flat surface of the race and the thrust surface of the cylinder block can be prevented. Thus, noise in the compressor, damage to the thrust bearing, and damage to the neighboring members can be prevented.

Third, when incorrect assembly is performed, the protrusions interfere with the piston so that incorrect assembly can be easily found and assembly can be easily performed.

Although the present invention is described based on the above preferred embodiment shown in the drawings, the preferred embodiment is a just example and the present invention may be applied to a swash plate compressor as well as a compressor having variable capacity or a scroll type compressor. That is, by converting a rotational movement of the drive shaft to a linear reciprocating movement or utilizing the rotational movement itself, in a compressor having a thrust bearing for supporting thrust of the rotational shaft and a race for guiding the thrust bearing, at least two rotation preventing protrusions can be formed at an identical interval at the race to preventing abrasion generated at a level surface of the race and other surfaces contacting the same due to rotation of the race.

What is claimed is:

1. A swash plate compressor comprising:

a drive shaft rotated by a driving source;

a swash plate fixedly installed on the drive shaft;

a piston reciprocated by the swash plate;

a cylinder bore, in which the piston is slidingly installed, for guiding reciprocation of the piston;

a thrust bearing supporting a thrust force generated by the swash plate and the drive shaft;

a race having a protrusion for preventing rotation, the protrusion extending radially and being located at an outer circumference of the race; and a cylinder block having a protrusion fixing means for preventing rotation of the race by engaging the protrusion of the race, wherein the protrusion fixing means includes at least one pair of protrusion stoppers facing each other and located proximate a drive shaft insertion hole of the cylinder block.

2. The compressor as claimed in claim 1, wherein the protrusion fixing means includes at least one protrusion insertion hole located proximate the drive shaft insertion hole of the cylinder block.

3. The compressor as claimed in claim 1, including at least two protrusions for preventing rotation fixedly supported at the protrusion fixing means of the cylinder block.

4. The compressor as claimed in claim 1, including a plurality of protrusions for preventing rotation located at a uniform angular interval on the race.

5. A swash plate compressor comprising:

a drive shaft rotated by a driving source;

a swash plate fixedly installed on the drive shaft;

a piston reciprocated by the swash plate;

a cylinder bore, in which the piston is slidingly installed, for guiding reciprocation of the piston;

a thrust bearing supporting a thrust force generated by the swash plate and the drive shaft;

a race having a protrusion for preventing rotation, the protrusion extending radially and being located at an outer circumference of the race; and a cylinder block having a protrusion fixing means for preventing rotation of the race by engaging the protrusion of the race, wherein the protrusion fixing means includes at least one protrusion insertion hole located proximate the drive shaft insertion hole of the cylinder block.

6. The compressor as claimed in claim 5, including at least two protrusions for preventing rotation fixedly supported at the protrusion fixing means of the cylinder block.

7. The compressor as claimed in claim 5, including a plurality of protrusions for preventing rotation located at a uniform angular interval on the race.

* * * * *